US011143053B2

(12) United States Patent
Liu

(10) Patent No.: US 11,143,053 B2
(45) Date of Patent: Oct. 12, 2021

(54) LOW FRICTION INLET NOZZLE FOR A TURBO EXPANDER

(71) Applicant: L'Air Liquide, Société Anonyme pour l'Etude et l'Exploitation des Procédés Georges Claude, Paris (FR)

(72) Inventor: Jingfeng Liu, Shanghai (CN)

(73) Assignee: L'Air Liquide, Société Anonyme pour l'Etude et l'Exploitation des Procédés Georges Claude, Paris (FR)

( * ) Notice: Subject to any disclaimer, the term of this patent is extended or adjusted under 35 U.S.C. 154(b) by 14 days.

(21) Appl. No.: 16/461,500

(22) PCT Filed: Nov. 18, 2016

(86) PCT No.: PCT/CN2016/106323
§ 371 (c)(1),
(2) Date: May 16, 2019

(87) PCT Pub. No.: WO2018/090307
PCT Pub. Date: May 24, 2018

(65) Prior Publication Data

US 2019/0345840 A1 Nov. 14, 2019

(51) Int. Cl.
*F01D 17/16* (2006.01)

(52) U.S. Cl.
CPC ..... *F01D 17/165* (2013.01); *F05D 2220/60* (2013.01); *F05D 2240/90* (2013.01)

(58) Field of Classification Search
CPC ..... F01D 17/00; F01D 17/10; F01D 17/12; F01D 17/14; F01D 17/16; F01D 17/162; F01D 17/165
See application file for complete search history.

(56) References Cited

U.S. PATENT DOCUMENTS 5,851,104 A 12/1998 Dakin et al.
6,314,736 B1 11/2001 Daudel et al.
8,641,372 B2 2/2014 Stein et al.
(Continued)

FOREIGN PATENT DOCUMENTS

CN 101663466 3/2010
CN 102762838 10/2012
(Continued)

OTHER PUBLICATIONS

DE-102012103412-A1 Machine Translation. Accessed EPO website Aug. 26, 2020. 7 pages. (Year: 2013).*
(Continued)

*Primary Examiner* — Richard A Edgar
(74) *Attorney, Agent, or Firm* — Elwood L. Haynes

(57) ABSTRACT

A low friction inlet nozzle for a turbo expander including a nozzle cover ring, wherein the nozzle cover ring includes a face, a set of nozzle blades, wherein each nozzle blade includes a face, a set of pressure springs, and a set of axial loading bolts is provided. The axial loading bolts may be configured to accept all or at least a portion of the force which the set of pressure springs induces between the nozzle cover ring and the face of the nozzle blades, thereby locating the first face of the nozzle blade at a predetermined distance away from the face of the nozzle cover ring. The predetermined distance may be between 0.02 and 0.04 mm.

2 Claims, 4 Drawing Sheets

(56) References Cited

U.S. PATENT DOCUMENTS

| | | | |
|---|---|---|---|
| 2009/0257867 | A1 | 10/2009 | Fleig et al. |
| 2010/0150701 | A1 | 6/2010 | Simon et al. |
| 2010/0290895 | A1 | 11/2010 | Ahrens |
| 2013/0149129 | A1 | 6/2013 | Matsuyama et al. |
| 2016/0245160 | A1 | 8/2016 | Ueda et al. |

FOREIGN PATENT DOCUMENTS

| | | | | | |
|---|---|---|---|---|---|
| CN | 105723067 | | | 6/2016 | |
| DE | 10 2008 060251 | | | 6/2010 | |
| DE | 102012103412 | A1 | * | 10/2013 | ..... F01D 17/165 |
| DE | 10 2012 211417 | | | 1/2014 | |
| EP | 3 064 720 | | | 9/2016 | |
| JP | 60175707 | A | * | 9/1985 | ..... F01D 17/165 |

OTHER PUBLICATIONS

JP-60175707-A Machine Translation. Accessed JPO website Aug. 27, 2020. 9 pages. (Year: 1985).*

International Search Report and Written Opinion for corresponding PCT/CN2016/106323, dated Aug. 21, 2017.

* cited by examiner 5,851,104

LOW FRICTION INLET NOZZLE FOR A TURBO EXPANDER

CROSS REFERENCE TO RELATED APPLICATIONS

This application is a 371 of International PCT Application PCT/CN2016/106323, filed Nov. 18, 2016, the entire contents of which are incorporated herein by reference.

BACKGROUND

Recently the interest in recovering energy from high-temperature or high-pressure gases has increased. However, the available devices are not as efficient as possible and suffer from certain limitations that are discussed later. As any high-temperature or high-pressure gas is a potential resource for energy recovery, generator-loaded expanders or turbines or turbo expanders can be custom engineered to recover a large amount of useful energy available in the process.

One field in which turbo expanders play a role is waste heat recovery. Waste heat can be converted to useful energy with a turbo expander-generator alone or as a component in a more complex system. Potential heat sources include: tail gas from industrial furnaces or combustion engines, waste vapor from industrial furnaces or combustion engines, waste vapor from chemical and petrochemical processes, and solar heat from flat or parabolic reflectors. Exhaust gases are hot and may contain solvents or catalysts. An expander can not only recover energy and cool down exhaust gases which vent to the atmosphere, it can also separate solvents or catalysts.

Another field in which turbo expanders are useful is the extraction of useful work in pressure letdown applications. In pressure letdown applications, such as the merging of two transmission pipelines at different pressures or at a city gate of a gas distribution system, a turbo expander-generator can reduce the pressure of large volume gas streams while at the same time recovering energy in the form of electric power. An expander can therefore be a profitable replacement for other pressure regulating equipment such as control valves and regulators.

A turbo expander, also referred to as a turbo-expander or an expansion turbine, is a centrifugal or axial flow turbine through which a high-pressure gas is expanded to produce work that is often used to drive a compressor. Because work is extracted from the expanding high-pressure gas, the gas expansion may approach an isentropic process (i.e., a constant entropy process) and the low pressure exhaust gas from the turbine is at a low temperature, sometimes as low as −90.degree. C. or less.

Because of the low temperature generated, turbo expanders are widely used as sources of refrigeration in industrial processes such as the extraction of ethane and the formation of liquefied natural gas (NGLs) from natural gas, the liquefaction of gases (such as oxygen, nitrogen, helium, argon and krypton) and other low-temperature processes.

A representative, but non-limiting, example of a turbo expander is shown in FIG. 1, and FIG. 2, which is reproduced from U.S. Pat. No. 5,851,104, the entire content of which is incorporated herein by reference. FIG. 1 shows a variable nozzle arrangement in a radial inflow turbine. A fixed ring 109 is positioned to one side of the annular inlet 114. The nozzle adjustment system is provided to the same side of the annular inlet 114. An adjusting ring 115 is arranged radially outwardly of a fixed ring 109. The adjusting ring 115 is able to rotate about the fixed ring 109 which is prevented from rotating by nozzle pivot pins 106 anchored in the fixed ring 109.

Inlet nozzles 105 are located about the annular inlet 114. These vanes 105 are positioned between the fixed ring 109 and adjusting ring 115 on one side and the nozzle cover ring 101 on the other. The vanes 105 are configured to provide a streamlined flow path there between. This path may be increased or decreased in cross-sectional area based on the rotational position of the vanes 105. The vanes 105 are pivotally mounted about the nozzle pivot pins 106. The relative positioning of the vanes 105 with respect to the nozzle cover ring 101 is illustrated by the superimposed phantom line in FIG. 2. Expander wheel 118 receives the compressed gas stream that is directed through the annular inlet 114 and through vanes 105. This compressed gas stream expands and causes the expander wheel 118 to rotate, thereby producing work.

In the U.S. Pat. No. 5,851,104, the nozzle adjusting mechanism includes a cam and cam follower mechanism. Cam followers 116 are displaced laterally from the axis of the pins 106 and are fixed by shafts in the vanes 105, respectively, as shown in FIG. 2. The cam followers 116 rotate about the shafts freely. To cooperate with the cam followers 116, cams in the form of biased slots 117 are arranged in the adjusting ring 115 (not shown in FIG. 2). They are sized to receive the cam followers 116 so as to allow for free-rolling movement as the adjusting ring 115 is rotated.

The above described arrangement of the vanes 105, cam followers 116, biased slots 117 and the adjusting ring 115 make the opening of the vanes 105 linearly dependant on a rotation of the adjusting ring 115. In other words, a given rotation of the adjusting ring 115 produces the same preset rotation of the vanes 105 irrespective of whether the vanes 105 are near an opened position, are in an opened position, are near a closed position or are in a closed position. This constant rotation of the vanes 105 with the rotation of the adjusting ring 115 does not allow for any varied sensitivity in the adjustment of the position of vanes 105.

In traditional turbo expanders an adjusting ring typically directly slides on vanes which produces friction and may damage part of the adjusting ring and/or vanes. The same sliding motion may prematurely wear the adjusting ring and/or vanes. A specific, but non-limiting, example would be the Atlas Copco ETB type expander nozzle. This nozzle is of the same basic design as defined above, and typically has poor reliability. The industry sees a high failure frequency which is caused by inlet guide vanes (nozzles) sticking. Typically, after such a failure, a total overhaul is performed, but given that the basic design has not changed, these nozzles can only be operated a short time before another failure can be expected.

Accordingly, a need has arisen in the industry to provide a solution to avoid the afore-described problems.

SUMMARY

A low friction inlet nozzle for a turbo expander including a nozzle cover ring, a set of nozzle blades, a set of pressure springs, and a set of axial loading bolts is provided. The axial loading bolts may be configured to accept all or at least a portion of the force which the set of pressure springs induces between the nozzle cover ring and the face of the nozzle blades, thereby locating the first face of the nozzle blade at a predetermined distance away from the face of the nozzle cover ring. The predetermined distance may be between 0.02 and 0.04 mm.

BRIEF DESCRIPTION OF THE FIGURES

For a further understanding of the nature and objects for the present invention, reference should be made to the following detailed description, taken in conjunction with the accompanying drawings, in which like elements are given the same or analogous reference numbers and wherein.

DESCRIPTION OF PREFERRED EMBODIMENTS

Figure 1:
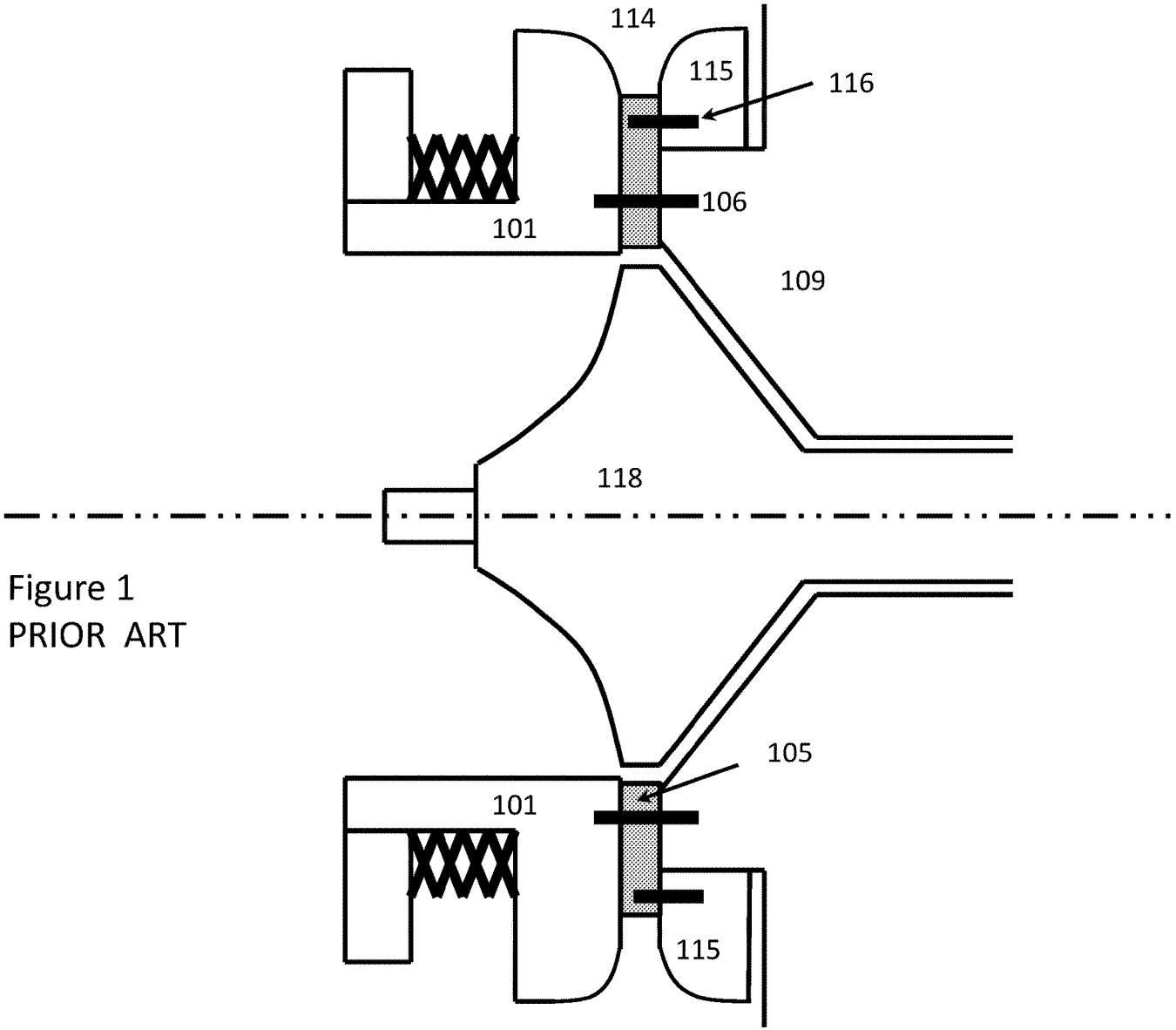
Figure 1 PRIOR ART
FIG. 1 schematically illustrates the cross section of a typical turbo expander as known to the prior art.
Figure 2:
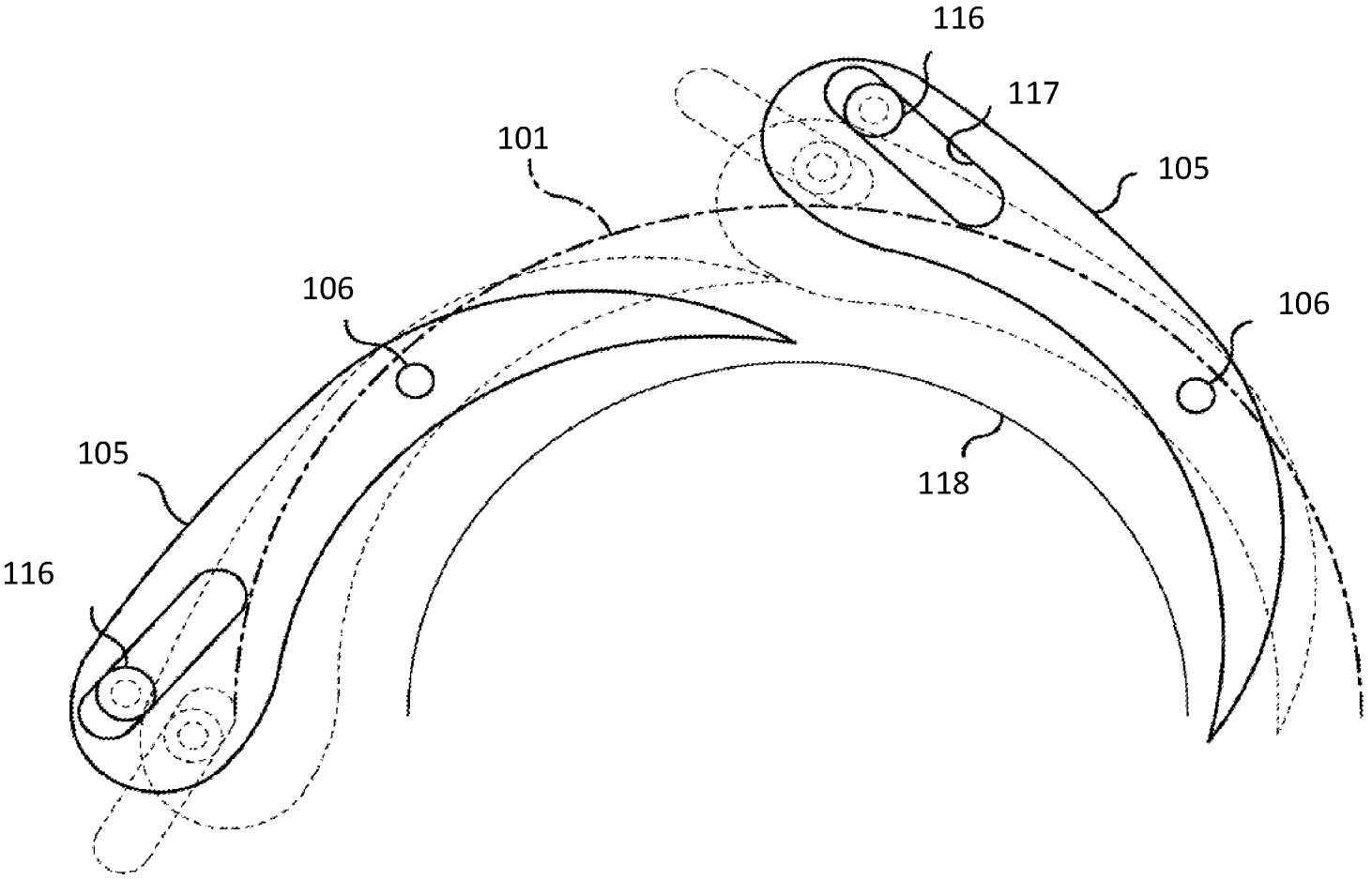
Figure 2 PRIOR ART
FIG. 2 schematically illustrates details of the inlet guide vanes (nozzle blades) as known to the prior art.

Illustrative embodiments of the invention are described below. While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

FIGURE ELEMENTS

100=turbo expander
101=nozzle cover ring
102=nozzle cover ring face
103=nozzle cover ring first pivot pin orifice
104=nozzle cover ring axial loading bolt orifice
105=inlet nozzles
106=nozzle pivot pins
107=nozzle first face
108=nozzle second face
109=fixed ring
110=fixed ring face
111=fixed ring second pivot pin orifice
112=fixed ring pressure springs
113=fixed ring axial loading bolts
114=annular inlet
115=adjusting ring
116=cam followers
117=nozzle biased slots
118=expander wheel With respect to the above identified problems, after analysis and testing, it was found that the root cause of many nozzle failures were the high amount of friction between the moving parts of the nozzle. The various embodiments of the proposed invention reduce this friction, possibly to zero.

As the intention of the present invention is to remedy these problems in situ, to existing turbo-expander installations, as much of the original design as possible must be maintained. In some embodiments of the present invention axial loading bolts 113 are utilized to reduce the preload, possibly to zero.

Figure 3:
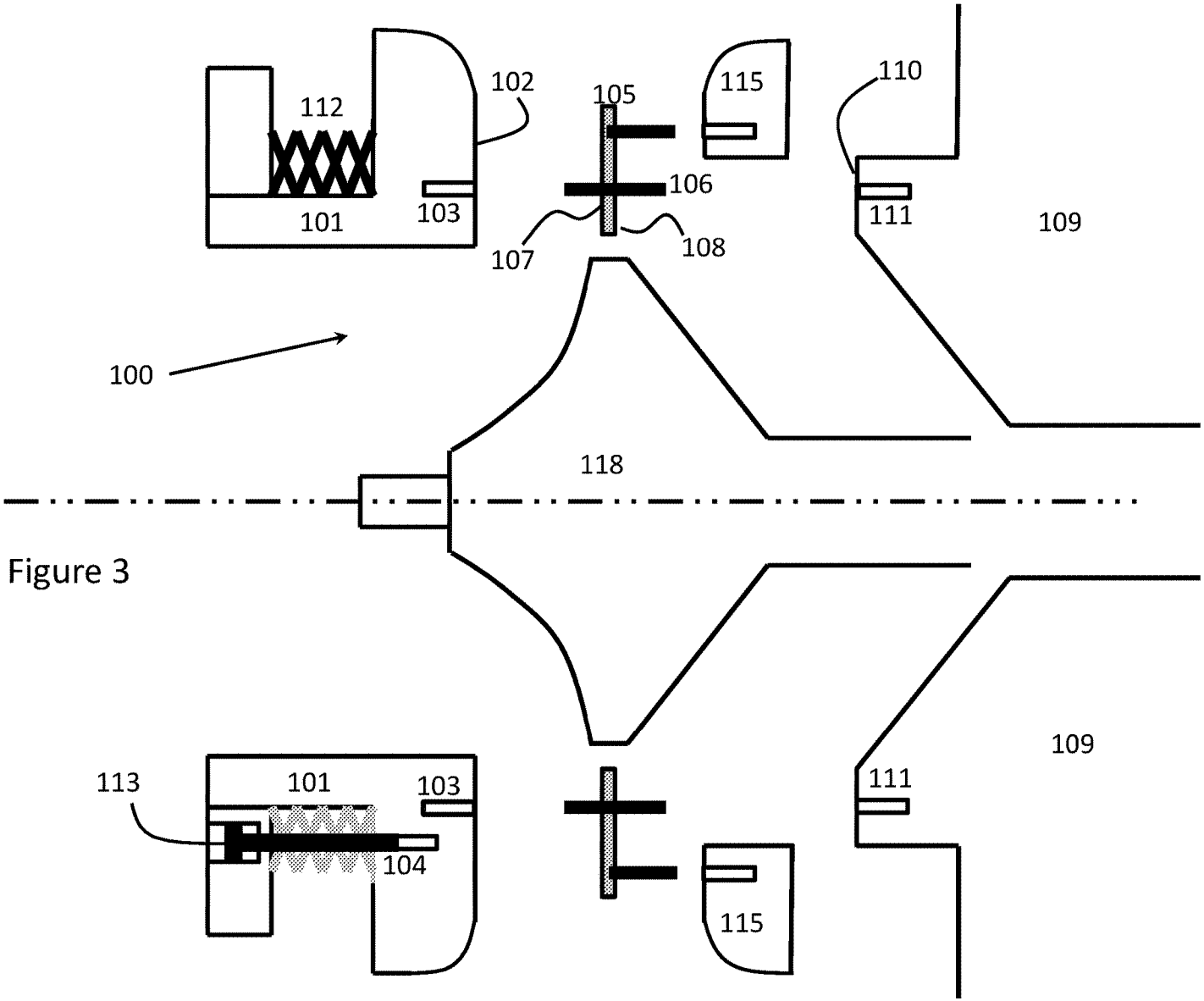
FIG. 3 schematically illustrates an exploded cross section of a turbo expander in accordance with one embodiment of the present invention.

Turning to FIG. 3, an exploded view of a low friction inlet nozzle for a turbo expander 100 in accordance with one embodiment of the present invention is provided. The nozzle includes a nozzle cover ring 101, wherein the nozzle cover ring 101 comprises a face 102, a first pivot pin orifice 103, and an axial loading bolt orifice 104. The nozzle also includes a set of nozzle blades 105, wherein each nozzle blade 105 comprises a pivot pin 106, a first face 107 and a second face 108. Also included is a fixed ring 109, wherein the fixed ring comprises a face 110 and a second pivot pin orifice 111, a set of pressure springs 112, and a set of axial loading bolts 113. The number of axial loading bolts 113 will depend on the size and design of the turbo expander, but in one embodiment of the present invention, there may be 8 axial loading bolts 113.

Figure 4:
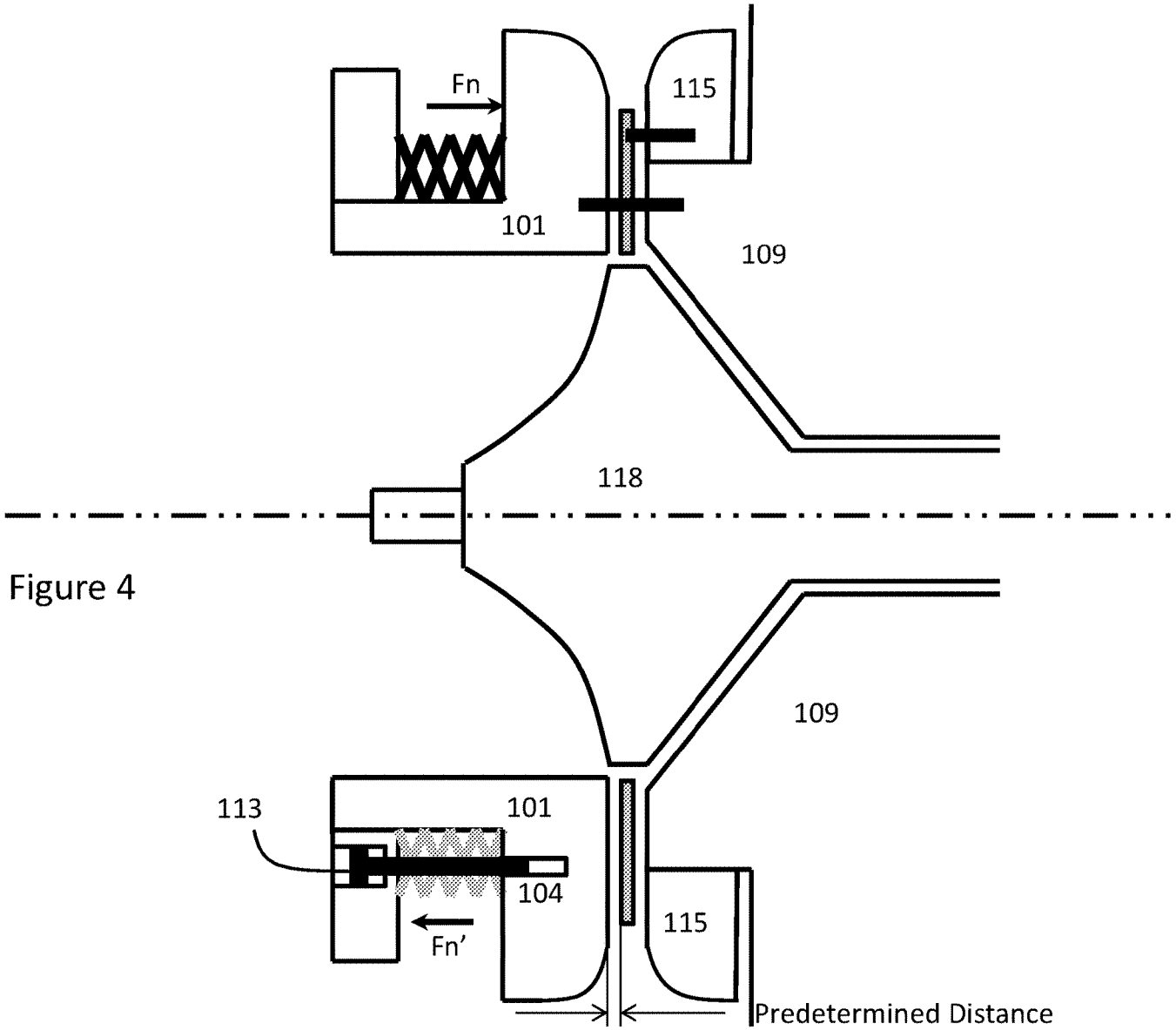
FIG. 4 schematically illustrates across section of a turbo expander in accordance with one embodiment of the present invention.

Turning to FIG. 4, and in the interest of consistency and clarity maintaining the element numbers from the prior figures, the axial loading bolts 113 are configured to accept all or at least a portion of the force which the set of pressure springs 112 induces between the nozzle cover ring 101 and the first face 107 of the nozzle blades 105. And the first face 107 of the nozzle blade 105 is located at a predetermined distance away from the face 102 of the nozzle cover ring 101. As the preloading force generated by the pressure springs 112 has been reduced to zero, the second face 108 of each nozzle blade 105 is no longer being forced into in contact with the face 110 of the fixed ring 109.

The inventors discovered that a major source of friction arises along the contacting surfaces of the nozzle cover ring 101, nozzle blade 105, and fixed ring 109. This results in sliding friction on the nozzle blades 105. The precondition of slide friction is contact surface (pressure) "Fn", roughness "μ" and sliding. The force of friction for each blade is $F=Fn*\mu_o$ It is clear from this equation that to reduce friction "F", either the preload "Fn" or the surface roughness "μ" must be reduced. In various embodiments of the present invention, the preload "Fn" is reduced.

In one embodiment of the present invention, the preload that pressure springs 112 places on the nozzle blades 105 is F, as indicated in FIG. 4. The axial loading bolts 113 are adjusted to reduce this preload by drawing the cover ring 101 to the left (as indicated in FIG. 4) and thus away from nozzle blades 105. Once the preload has been reduced to zero, further adjustment of the axial loading bolts 113 produces a gap between the nozzle cover ring 101 and the nozzle blades 105. Once this gap reaches predetermined distance, this is set. This predetermined distance may be between 0.02 and 0.04 mm.

Thus, the friction between the nozzle cover ring 101 and the nozzle blades 105 has been reduced to zero. Also, the friction between the nozzle blades 105 and the fixed ring 109 has been reduced to zero.

It will be understood that many additional changes in the details, materials, steps and arrangement of parts, which have been herein described in order to explain the nature of the invention, may be made by those skilled in the art within the principle and scope of the invention as expressed in the appended claims. Thus, the present invention is not intended to be limited to the specific embodiments in the examples given above.

The invention claimed is:

1. A low friction inlet nozzle for a turbo expander, comprising:

a nozzle cover ring, wherein the nozzle cover ring comprises a face, and is configured to receive a first end of a pivot pin, a set of inlet nozzle blades, wherein each inlet nozzle blade comprises a face, and the pivot pin, the pivot pin comprising the first end and a second end, a fixed ring configured to receive the second end of the pivot pin, a set of pressure springs, and a set of axial loading bolts wherein the axial loading bolts are configured to accept all or at least a portion of the force which the set of pressure springs induces between the nozzle cover ring and the faces of the inlet nozzle blades, thereby locating the faces of the inlet nozzle blades at a predetermined distance away from the face of the nozzle cover ring, wherein the first end of the pivot pin is rotationally attached to the nozzle cover ring, and the second end of the pivot pin is rotationally attached to the fixed ring, thereby allowing the inlet nozzle blades to pivot relative to the fixed ring and the nozzle cover ring.

2. The low friction inlet nozzle of claim 1, wherein the predetermined distance is between 0.02 and 0.04 mm.

* * * * *